US006494261B1

(12) United States Patent
Pahmiyer

(10) Patent No.: US 6,494,261 B1
(45) Date of Patent: Dec. 17, 2002

(54) APPARATUS AND METHODS FOR PERFORATING A SUBTERRANEAN FORMATION

(75) Inventor: Robert Carl Pahmiyer, Houston, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/640,572

(22) Filed: Aug. 16, 2000

(51) Int. Cl.[7] ..... E21B 29/02
(52) U.S. Cl. ..... 166/281; 166/297; 166/55.1
(58) Field of Search ..... 166/281, 297, 166/298, 55, 55.1

(56) References Cited

U.S. PATENT DOCUMENTS

| | | | | |
|---|---|---|---|---|
| 1,514,062 A | | 11/1924 | McLain | |
| 3,179,168 A | | 4/1965 | Vincent | 166/14 |
| 3,203,483 A | | 8/1965 | Vincent | 166/207 |
| 3,270,817 A | | 9/1966 | Papaila | 166/46 |
| 3,353,599 A | | 11/1967 | Swift | 166/15 |
| 3,477,506 A | | 11/1969 | Malone | 166/207 |
| 3,498,376 A | | 3/1970 | Sizer et al. | 166/120 |
| 3,669,190 A | | 6/1972 | Sizer et al. | 166/315 |
| 3,746,091 A | | 7/1973 | Owen et al. | 166/207 |
| 3,776,307 A | | 12/1973 | Young | 166/125 |
| 4,095,825 A | | 6/1978 | Butler | 285/55 |
| 4,687,232 A | | 8/1987 | Zimmerman | 285/31 |
| 4,819,728 A | * | 4/1989 | Lafitte | 166/298 |
| 5,014,779 A | | 5/1991 | Meling et al. | 166/55.7 |
| 5,667,011 A | | 9/1997 | Gill et al. | 166/295 |
| 5,924,745 A | | 7/1999 | Campbell | 285/90 |
| 5,984,568 A | | 11/1999 | Lohbeck | 403/375 |
| 6,012,523 A | | 1/2000 | Campbell et al. | 166/277 |
| 6,021,850 A | | 2/2000 | Wood et al. | 166/380 |
| 6,029,748 A | | 2/2000 | Forsyth et al. | 166/380 |
| 6,070,671 A | | 6/2000 | Cumming et al. | 166/381 |
| 6,216,783 B1 | * | 4/2001 | Hocking et al. | 166/250.1 |
| 6,237,688 B1 | * | 5/2001 | Burleson et al. | 166/281 |
| 6,286,598 B1 | * | 9/2001 | van Petegem et al. | 166/297 |
| 6,397,950 B1 | * | 6/2002 | Streich et al. | 166/376 |

FOREIGN PATENT DOCUMENTS

| | | |
|---|---|---|
| GB | 2 344 606 A | 6/2000 |
| WO | WO 96/37680 | 11/1996 |
| WO | WO 97/17527 | 5/1997 |
| WO | WO 98/49423 | 11/1998 |
| WO | WO 99/56000 | 11/1999 |
| WO | WO 00/26500 | 5/2000 |
| WO | WO 00/26501 | 5/2000 |
| WO | WO 00/26502 | 5/2000 |

* cited by examiner

*Primary Examiner*—William Neuder
(74) *Attorney, Agent, or Firm*—William M. Inwalle; John F. Booth

(57) ABSTRACT

Apparatus and methods for perforating a subterranean well are provided. In general perforating apparatus, including a pre-weakend casing apparatus and a propellant assembly, is deployed within a formation of the well. Activation of the propellant assembly perforates the pre-weakened casing apparatus and the well formation. The invention can accomplish perforation and sand-control operations in a single trip.

22 Claims, 4 Drawing Sheets

APPARATUS AND METHODS FOR PERFORATING A SUBTERRANEAN FORMATION

TECHNICAL FIELD

BACKGROUND OF THE INVENTIONS

A subterranean gas or oil well typically begins with a hole bored into the earth, which is then lined with joined lengths of relatively large diameter metal pipe. The casing thus formed is generally cemented to the face of the hole to give the well integrity and a path for producing fluids to the surface. Conventionally, the casing and cement are subsequently perforated with chemical or mechanical means in one or more locations of the surrounding formation from which it is desired to extract fluids. In general, the perforations extend a short distance into the formation. One of the problems inherent in the art is in maintaining a balance between perforation size and spacing and the required structural integrity of the casing.

Much effort has been devoted to developing apparatus and methods of perforation. Explosive charges are sometimes used to construct perforating guns, such as disclosed for example in, U.S. Pat. No. 5,701,964 to Walker et al. Problems exist with explosive perforation devices. The physical size and arrangement of the perforating gun are often constrained by the tubing size. For example, in the perforation of a five inch diameter casing, it may be necessary for the perforating gun to pass through one and eleven-sixteenth inch diameter tubing. The limited size of the perforating assembly creates problems in orienting the charges to achieve the desired perforation density and pattern.

Attempts have been made to increase the effectiveness of explosive perforation methods by combining them with propellant fracture devices. An example of such attempts is disclosed in U.S. Pat. No. 5,775,426 to Snider et al, wherein a sheath of propellant material is positioned to substantially encircle at least one shaped charge. Under this method, the propellant generates high pressure gasses which clean the perforations left by the explosive charge. This method and apparatus suffers from limitations imposed by physical size restraints similar to those discussed above.

It has been observed that the use of explosive charges to perforate a well can cause additional problems resulting from the damage to the formation. Damage to the formation can restrict the flow of fluids into the well. Formation damage due to explosive charges also produces debris which can then be carried by fluids into the production stream. Additionally, explosive perforation can perforate control lines, requiring repairs before production can begin.

A production issue closely related to perforation is sand-control. The introduction of particles larger in cross section than a chosen size, whether sand, gravel, mineral, soil, organic matter, or a combination thereof into the production stream of the well commonly occurs, requiring methods of sand-control. The introduction of these materials into the well often causes problems, including plugged formations or well tubings, and erosion of tubing and equipment. There have therefore been numerous attempts to prevent the introduction of sand and gravel into the production stream.

A common method to prevent the introduction of sand and gravel into the production stream has been the use of a sand-control screen. In general, this involves placing a sand-control screen jacket assembly between the wellbore and a base pipe. The sand-control screen jacket assembly is designed to allow well fluids to flow into the base pipe while excluding other material. Many variations of sand-control screen jacket assemblies exist, including a radially expandable sand-control screenjacket assembly. The methods of using, a radially expandable screen jacket assembly includes causing the radial expansion of the base pipe and surrounding screen jacket assembly by drawing a mechanical expansion tool through the base pipe. Attempts to perforate a well containing a sand-control screen jacket assembly have the added problem of avoiding failure of the screen during the perforation operation.

Most perforating prior to sand control is conducted with tubing-conveyed perforating guns. This allows the perforation hole size and shot density to be maximized as well as allowing the well to be perforated in an under-balanced condition. Perforating in an under-balanced condition causes the formation fluids to surge into the wellbore yielding a cleaning effect. After perforating in an under-balanced condition the well must be "killed" by circulating out the produced fluids and replacing them with heavier completion fluids. The perforating guns are then pulled from the hole and a completion packer and sand control equipment is run into the hole. During the pulling of perforating equipment and running of completion equipment it can be very difficult to control completion fluid loss into the formation. Oftentimes significant amounts of fluid are lost to the formation, which can be expensive and potentially damaging to productivity. Fluid loss pills are often required, which also can be expensive and damaging.

Some efforts have been made to combine well perforation and the use of screen assemblies in one operation. U.S. Pat. No. 5,845,712 to Griffith Jr. is an example of such apparatus and methods. The apparatus and methods involve perforating and gravel packing a well section in one downhole operation, or trip. The inventions and disclosures of U.S. Pat. No. 5,845,712 are incorporated herein for all purposes by this reference. These methods continue to have the above-mentioned problems associated with physical constraints imposed on explosive charges, and with the need to balance structural integrity of the well casing and screen assembly with useful perforation.

Due to the aforementioned problems associated with the perforation of a well casing and formation, and with the related problems of introducing sand and gravel into the production stream, a need exists for apparatus and methods providing improvements in perforation and associated sand-control.

SUMMARY OF THE INVENTIONS

The invention provides apparatus and methods for perforating a subterranean well. In general perforating apparatus, including a pre-weakened casing apparatus and a propellant assembly, is deployed within a formation of the well. Activation of the propellant assembly fails the pre-weakened casing apparatus perforates and the well formation.

According to one aspect of the invention, the pre-weakened casing apparatus has substantially orthogonal notches.

According to another aspect of the invention, the pre-weakened casing apparatus has notches in its inner surface.

According to yet another aspect of the invention, the pre-weakened casing apparatus has substantially conical notches.

According to another aspect of the invention, a sand-control screen jacket assembly is deployed in the well with the perforating apparatus.

According to still another aspect of the invention, perforation and sand-control steps are accomplished in a single trip.

BRIEF DESCRIPTION OF THE DRAWINGS

The accompanying drawings are incorporated into and form a part of the specification to illustrate several examples of the present inventions. These drawings together with the description serve to explain the principals of the inventions. The drawings are only for the purpose of illustrating preferred and alternative examples of how the inventions can be made and used and are not to be construed as limiting the inventions to only the illustrated and described examples. The various advantages and features of the present inventions will be apparent from a consideration of the drawings in which.

DETAILED DESCRIPTION

Figure 1:
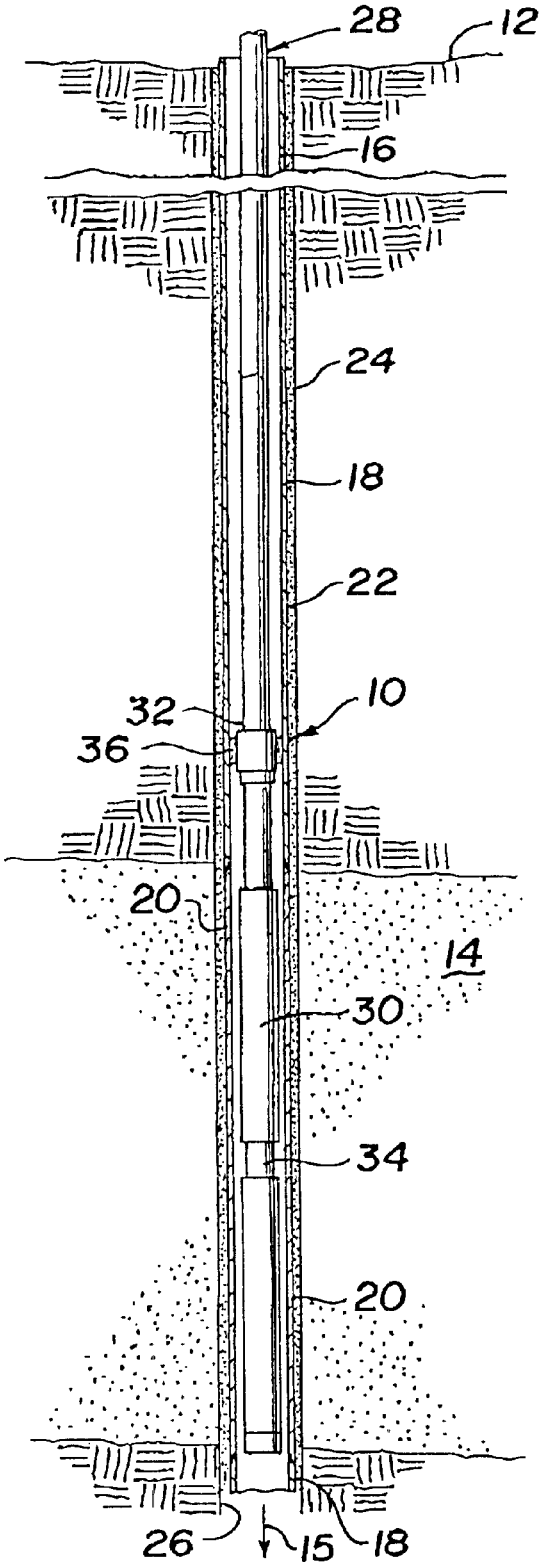
FIG. 1 is a longitudinal cross-sectional view of the apparatus of the present inventions positioned in a well.

The present inventions are described by reference to drawings showing one or more examples of how the inventions can be made and used. In these drawings, reference characters are used throughout the several views to indicate like or corresponding parts.

In the description which follows, like or corresponding parts are marked throughout the specification and drawings with the same reference numerals, respectively. The drawings are not necessarily to scale and the proportions of certain parts have been exaggerated to better illustrate details and features of the invention. In the following description, the terms "upper," "upward," "lower," "below," downhole", "longitudinally" and the like, as used herein, shall mean in relation to the bottom, or furthest extent of, the surrounding wellbore even though the wellbore or portions of it may be deviated or horizontal. Correspondingly, the "transverse" or "radial" orientation shall mean the orientation perpendicular to the longitudinal orientation. In the discussion which follows, generally cylindrical well, pipe and tube components are assumed unless expressed otherwise.

The apparatus and methods of the invention are shown generally in FIG. 1. A well 10 extends from the surface 12 at least into a subterranean formation 14, and may continue further downhole 15. The well 10 has a casing 16 consisting of connected conventional casing sections 18 and pre-weakened casing apparatus 20 of the invention, preferably secured directly to the end of a conventional casing section 18. The pre-weakened casing apparatus 20 is placed adjacent to the formation 14. Sections of the pre-weakened casing apparatus 20 may be connected together at casing connections 22 to span the formation 14. A jacket of cement 24 is solidified between the casing 16 and the wall of the wellbore 26.

Further referring primarily to FIG. 1, a tubing string 28 extends into the casing 16 from the surface 12. A propellant assembly 30 is preferably connected to the terminal end 32 of the tubing string 28. As with the pre-weakened casing 20, sections of the propellant assembly 30 may be joined with threaded connections 34 in order to span the formation 14. The propellant assembly 30 may alternatively be conveyed into the well by wireline, slickline, coil tubing or other means that will be apparent to those skilled in the arts. Any suitable means, such as one or more packers 36, may be used to isolate the portion of the well 10 that intersects the formation 14.

Figure 2:
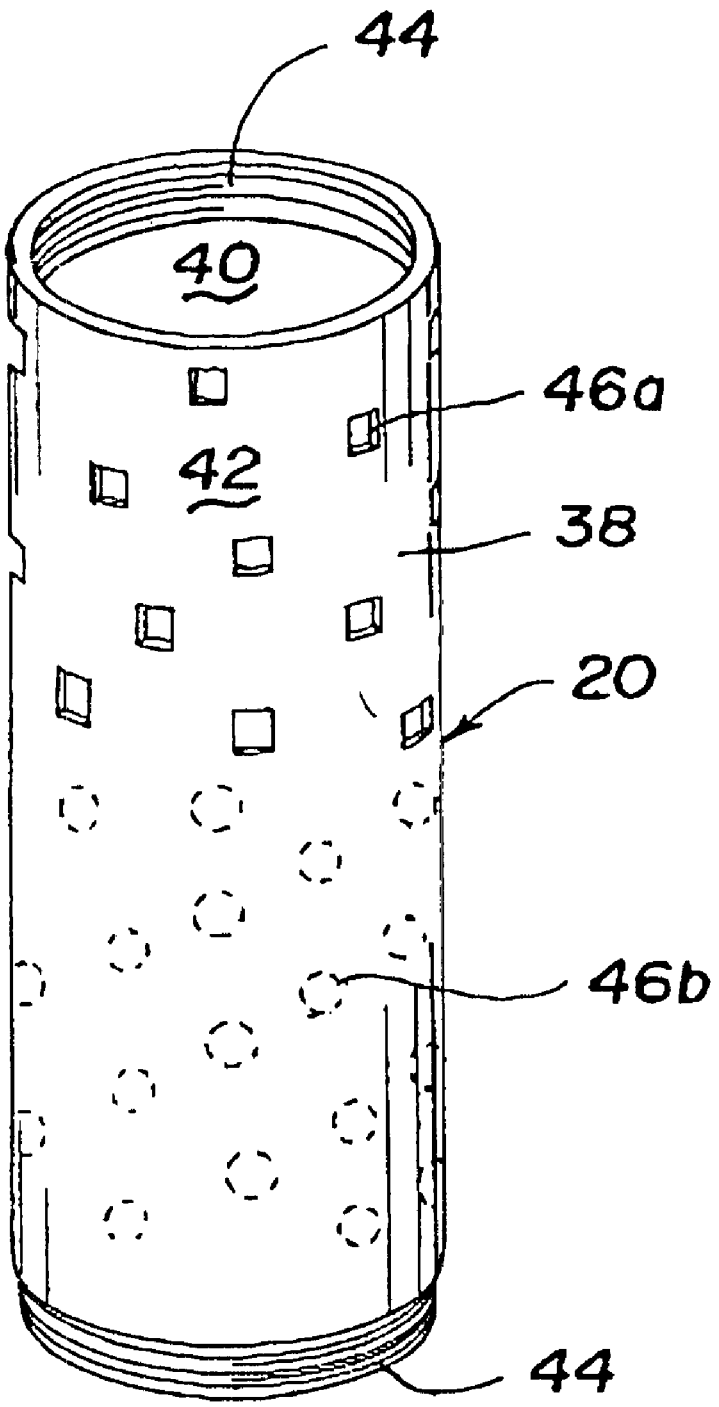
FIG. 2 is a top perspective view of an example of an embodiment of a well casing in accordance with the inventions.

Now referring to primarily to FIG. 2, a section of pre-weakened casing apparatus 20 is shown. A metal pipe 38 has an inner surface 40 and an outer surface 42. The surfaces 40, 42, may have threaded portions 44 at opposite ends to facilitate the connection of pre-weakened casing sections 20. Of course, other connecting means, such as mechanical couplings (not shown), will be apparent to those skilled in the arts. The pre-weakened casing apparatus 20 is connected to the appropriate section or sections of conventional well casing and cemented in place in the conventional manner. The pipe 38 of the pre-weakened casing section 20 has pre-weakened portions 46 incorporated throughout.

In the present description, the pre-weakened portions 46 are depicted in terms of notches milled or drilled into the surfaces of the pipe 38. This is the presently preferred embodiment and also the most readily illustrated. It should be understood that the pre-weakened portions may be otherwise incorporated into the manufacture of the pre-weakened casing section 20, and need not be visible to the naked eye. For example, the pre-weakened portions could be included by incorporating suitably-weakening materials such as soft metal portions into the pipe 38 during manufacture. The shape, size, pattern, and number of pre-weakened portions may be chosen to achieve a desired level of perforation and strength depending on known or predicted well conditions.

Further referring to FIG. 2, pre-weakened portions, such as perforation notches 46, are included on one or more of the surfaces 40, 42 of the pipe 38. Perforation notches 46*a* may be incorporated into the outer surface 42. In combination or alternatively, perforation notches 46*b* may be incorporated into the inner surface 40. The shape of the pre-weakened portions 46 is not critical to the invention, but some shapes, such as those described below are presently preferred. Planar perforation notches 46*a*, having one or more surfaces, are preferably milled into the outer surface 42 of the pipe 38. Substantially rectangular box-like perforation notches 46*a* are shown, but other shapes, such as, for example, pyramidal, tetrahedral, or cylindrical may also be used. The planar perforation notches 46*a* may be incorporated into the inner surface 40 of the pipe 38. Conical perforation notches 46*b* may also be used. Conical perforation notches 46*b* are substantially cone-shaped depressions on the inside of the pipe 38 with their apexes oriented toward the outer surface 42 of the pipe 38.

The pre-weakened portions 46 are designed to provide selected portions of pipe 38 susceptible to being removed by the activation of the propellant assembly (not shown). The perforation notches 46*a*, 46*b*, are spaced and arranged, in this illustration helically, to provide the desired pattern of perforation of the casing. The pre-arranged perforation notches 46 are particularly advantageous in that desired casing perforation arrangements and densities can be planned without the constraints imposed upon the arrangement of explosive charges known in the arts. The conical notches 46*b* are believed to be advantageous in concentrating the force exerted by the propellant in the manner of a nozzle.

Figure 3:
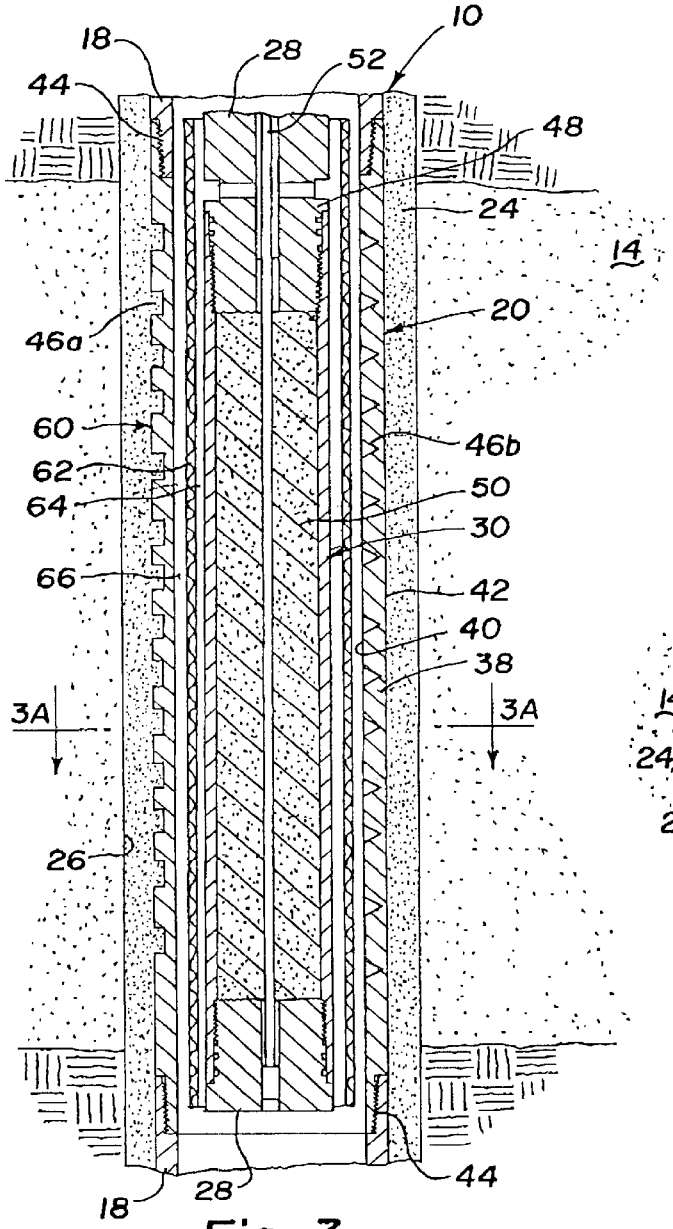
FIG. 3 is a longitudinal cross-sectional view of an embodiment of a well casing and propellant assembly positioned in a well in accordance with the invention.
Figure 3A:
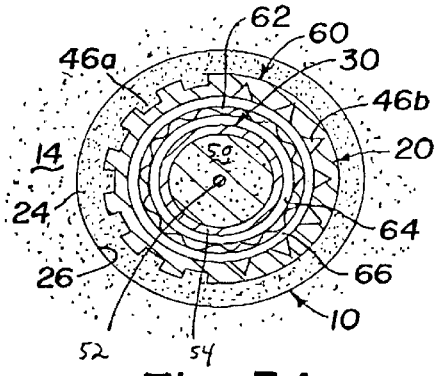
FIG. 3A is a transverse cross-sectional view taken along line 3A—3A of FIG. 3.

Referring now primarily to FIGS. 3 and 3A, the assembly and use of the apparatus and methods of the invention are further described. The propellant assembly 30 is shown. The propellant assembly 30 is preferably a commercially available extreme overbalancing perforation device such as the STIMTUBE tool, a registered trademark, available from Halliburton Energy Services Company, Houston, Tex. Alternatively, other commercially available or similarly operable pressure-producing extreme overbalancing perforation tools may be used. In general, the propellant assembly 30 has a threaded connection piece 48 at either end. The propellant assembly is generally directly connected to the end of the tubing string 28. A rapidly combustible but non-exploding propellant 50 is generally used. A detonator cord 52 is typically connected to a selectable activation means (not shown). A protective sheath 54 may cover the propellant 50 without impeding burning.

The propellant assembly 30 is placed inside the pre-weakend casing apparatus 20, which together form the perforation assembly 60. The perforation assembly 60 may be made of two or more casing apparatus sections 20 and two or more corresponding propellant assemblies 30 connected end-to-end. The perforation assembly 60 is placed in a portion of the well 10 where perforation of the formation 14 is desired. The perforation assembly 60 is connected at one or both ends to conventional well casing 18.

Optionally, a conventional sand-control screen jacket assembly 62 may be deployed in the formation region of the well for the purpose of providing sand-control after perforation is achieved. A first annular gap 64 exists between the sand-control screen jacket assembly 62 and the propellant assembly 30. A second annular gap 66 exists between the sand-control screen jacket assembly 62 and the casing assembly 20. The sand-control screen jacket assembly 62 may have one or more screens or shrouds or combination of screens and/or shrouds as often found in the art. The pressure produced by the propellant assembly is of a duration and intensity so as not to cause the sand-control screen jacket assembly to fail. The typical sand-control screen jacket assembly, being designed for the passage of fluids, has screens of relatively small surface area, permitting pressurized fluid from the activated propellant to pass through without damaging the screen jacket assembly. A radially expandable sand-control screen jacket assembly may alternatively be used.

Figure 4:
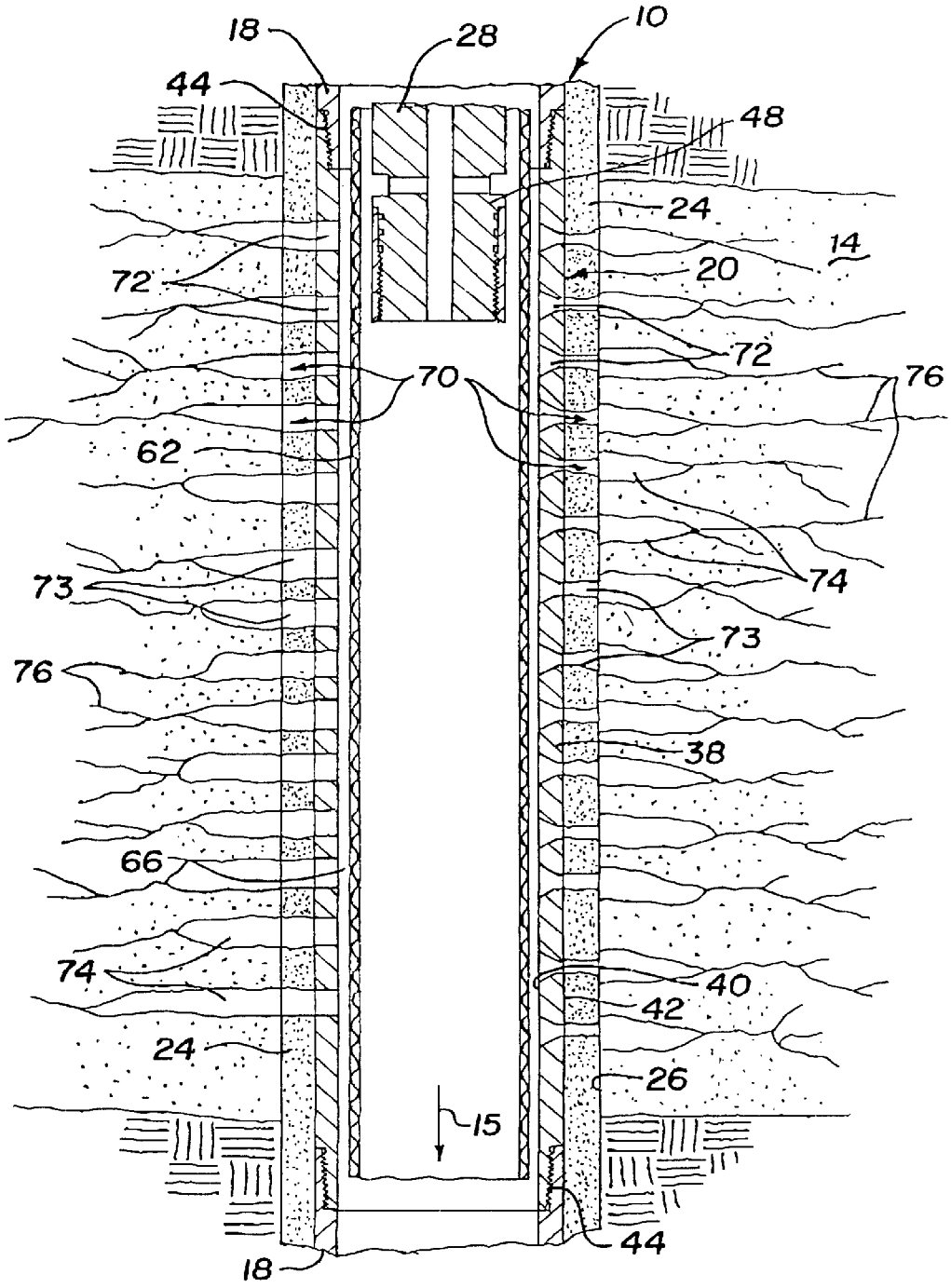
FIG. 4 is a longitudinal cross-sectional view of an embodiment of a well casing assembly positioned in a well following activation of the propellant assembly in accordance with the invention after positioning as shown in FIG. 3.

Now referring primarily to FIG. 4, an embodiment of a perforation assembly 60 is depicted in a well 10 following activation of the propellant assembly 30 and perforation of the casing assembly 20 in accordance with the invention. After positioning the perforation apparatus 60 in the well 10 as described, the propellant assembly 30 is activated. After activation, the propellant (not shown) burns completely, creating heat and high pressure fluid flow 70. The high pressure fluid flow 70 causes the notched casing assembly 20 to fail at the notches 46 therein, creating perforations 72 in the notched casing apparatus 20 and perforations 73 in the cement 24. The high pressure fluid flow 70 also penetrates the formation 14, causing perforations 74 and fractures 76 therein. If a radially expandable sand-control screen jacket assembly is used, it may be expanded by the high pressure fluid flow or in the conventional manner. The propellant assembly end piece 48 connected to the terminal end of the tubing string 28 may remain attached. Upon activation of the propellant assembly, propellant assembly end pieces (not shown) located downhole 15 of the upper end of the propellant assembly 20 are to typically allowed to fall into the rathole.

The invention described can accomplish perforating and installation of a sand-control screen jacket assembly in a single trip. This is a significant advantage over apparatus and methods in the art requiring separate trips for perforation and sand-control. The inventions also have advantages of offering complete control over factors relating to perforation density and pattern on the well casing.

The embodiments shown and described above are only exemplary. Many details are often found in the art such as: sand-control screen jacket assembly details, perforation configurations and casing materials. Therefore, many such details are neither shown nor described. It is not claimed that all of the details, parts, elements, or steps described and shown were invented herein. Even though numerous characteristics and advantages of the present inventions have been set forth in the foregoing description, together with details of the structure and function of the inventions, the disclosure is illustrative only, and changes may be made in the detail, especially in matters of shape, size and arrangement of the parts within the principles of the inventions to the full extent indicated by the broad general meaning of the terms used in the attached claims.

The restrictive description and drawings of the specific examples above do not point out what an infringement of this patent would be, but are to provide at least one explanation of how to make and use the inventions. The limits of the inventions and the bounds of the patent protection are measured by and defined in the following claims.

What is claimed:

1. Apparatus for perforating a subterranean well comprising:

a casing having a casing sidewall, the casing sidewall having a plurality of notches extending partially through the casing sidewall, the casing deployable in the well; and a propellant assembly deployable in the casing.

2. An apparatus for perforating a subterranean well according to claim 1 wherein the notches are substantially orthogonal.

3. An apparatus for perforating a subterranean well according to claim 1 wherein the casing sidewall has an inner surface, the notches in the inner surface of the sidewall.

4. An apparatus for perforating a subterranean well according to claim 3 wherein the notches are substantially conical notches.

5. A method of perforating a subterranean formation comprising the steps of:

placing a pre-weakened casing apparatus into the wellbore adjacent the formation, the pre-weakened casing having a sidewall with a plurality of notches extending partially therethrough;

placing a propellant assembly into the pre-weakened casing; and activating the propellant assembly, thereby perforating the pre-weakened casing and perforating and fracturing the adjoining formation.

6. A method of perforating a subterranean formation in accordance with claim 5 wherein the notches are on the interior of the casing.

7. A method of perforating a subterranean formation in accordance with claim 5 wherein the steps are performed in a single trip.

8. A method of perforating a subterranean formation in accordance with claim 5 wherein the notched casing has substantially orthogonal notches.

9. A method of perforating a subterranean formation in accordance with claim 6 wherein the notched casing has substantially conical notches.

10. A method as in claim 5, the wellbore having a wellbore wall, the method further comprising the step of placing cementitious material between the wellbore wall and the casing.

11. A method of perforating a subterranean formation comprising the steps of:

placing a pre-weakened casing apparatus into the wellbore adjacent the formation, the pre-weakened casing having a sidewall with a plurality of notches extending partially therethrough;

placing a screen jacket assembly into the pre-weakened casing;

placing a propellant assembly into the screen jacket assembly; and activating the propellant assembly, thereby perforating the pre-weakened casing and perforating and fracturing the adjoining formation.

12. A method of perforating a subterranean formation in accordance with claim 11 wherein the notched casing has substantially orthogonal notches.

13. A method of perforating a subterranean formation in accordance with claim 11 wherein the screen jacket assembly comprises a radially expandable screen jacket assembly.

14. A method of perforating a subterranean formation in accordance with claims 13 further comprising the step of:

radially expanding the screen jacket assembly.

15. A method of perforating a subterranean formation in accordance with claim 11 or 14 wherein the steps are performed in a single trip.

16. A method of perforating a subterranean formation in accordance with claim 11 wherein the notches are on the interior of the casing.

17. A method of perforating a subterranean formation in accordance with claim 16 wherein the notched casing has substantially conical notches.

18. A method as in claim 11, the wellbore having a wellbore wall, the method further comprising the step of placing cementitious material between the wellbore wall and the casing.

19. An apparatus for use in perforating a subterranean well comprising:

a casing deployable in a well, the casing having a sidewall with a plurality of notches therein, the plurality of notches extending partially through the casing sidewall, the plurality of notches creating selectively weakened portions in the casing sidewall for perforation by a propellant assembly.

20. An apparatus as in claim 19, wherein the plurality of notches are generally conical.

21. An apparatus for use in perforating a subterranean well comprising:

a casing deployable in a well, the casing having a sidewall of metal with a plurality of weaker portions, wherein the weaker portions are formed of metal softer than the metal of the casing; and a screen jacket assembly.

22. An apparatus as in claim 21 further comprising a propellant assembly deployable in the well.

* * * * *